US006599200B1

(12) United States Patent
Kallassy

(10) Patent No.: US 6,599,200 B1
(45) Date of Patent: Jul. 29, 2003

(54) GOLF SWING TRAINING DEVICE AND TRAINING METHOD

(76) Inventor: Charles A. Kallassy, 4074 S. Batter Dr., Dallas, TX (US) 75229

( * ) Notice: Subject to any disclaimer, the term of this patent is extended or adjusted under 35 U.S.C. 154(b) by 0 days.

(21) Appl. No.: 09/647,819

(22) PCT Filed: Nov. 25, 1998

(86) PCT No.: PCT/US98/25321

§ 371 (c)(1),
(2), (4) Date: Sep. 29, 2000

(87) PCT Pub. No.: WO99/26705

PCT Pub. Date: Jun. 3, 1999

Related U.S. Application Data

(60) Provisional application No. 60/066,674, filed on Nov. 26, 1997.

(51) Int. Cl.[7] ..... A63B 57/00
(52) U.S. Cl. ..... 473/204; 473/203; 473/206
(58) Field of Search ..... 473/204, 206, 473/295–300, 201, 203, 301–303, 568, 551, 552

(56) References Cited

U.S. PATENT DOCUMENTS

| | | | | | |
|---|---|---|---|---|---|
| 2,091,458 | A | * | 8/1937 | Sleight | 473/568 |
| 2,628,100 | A | | 2/1953 | Beebe | 273/81 |
| 2,962,288 | A | * | 11/1960 | Lowden | 473/204 |
| 3,095,198 | A | | 6/1963 | Gasche | 273/165 |
| 3,806,130 | A | * | 4/1974 | Jacques | 473/206 |
| 3,940,134 | A | * | 2/1976 | Bieganowski | 473/206 |
| 4,943,058 | A | * | 7/1990 | Carbonetti | 473/551 |
| 4,982,963 | A | | 1/1991 | Fazio | 273/186 A |
| 5,588,651 | A | * | 12/1996 | Frost | 473/206 |
| 5,816,961 | A | * | 10/1998 | Kraemer | 473/560 |
| 5,830,081 | A | * | 11/1998 | Kitahara | 473/294 |
| 5,839,983 | A | * | 11/1998 | Kramer | 473/568 |

* cited by examiner

*Primary Examiner*—Mark S. Graham
*Assistant Examiner*—Raeann Gorden
(74) *Attorney, Agent, or Firm*—Darby & Darby

(57) ABSTRACT

The present invention provides a dynamic swing training device and method for progressively conditioning muscle memory to achieve a consistently repeatable and proper golf swing. The golf swing training device of the present invention in its preferred embodiment is similar to a conventional golf club with an elongated shaft and at one end, but modified to provide a unique dynamic hand, arm and body action during the swing. In the case of a right-handed golfer, the device handle is grasped by the left hand of the trainee, and a slidable grip is provided for grasping by the right hand of the trainee. The slidable grip is slidable longitudinally with respect to the shaft so that the right hand moves progressively down the shaft during the backswing and then progressively back into proximity with the left hand during the downswing.

2 Claims, 8 Drawing Sheets

GOLF SWING TRAINING DEVICE AND TRAINING METHOD

CROSS-REFERENCE TO RELATED APPLICATION

This Application was filed under 35 U.S.C. § 371 as a National Phase Application of PCT Application No. PCT/US98/25321, filed Nov. 25, 1998, which itself claims priority from U.S. Provisional Application Ser. No. 60/066,674, filed Nov. 26, 1997.

FIELD OF THE INVENTION

This invention relates generally to devices for training a golfer to execute a golf swing, and more particularly to a training device for physically experiencing, practicing and committing to memory numerous aspects of the body's movement during a golf swing. Additionally, this invention relates to a method of golf swing instruction using such a training device.

BACKGROUND OF THE INVENTION

The difficult task of producing a repeatable golf swing has been the elusive goal of golfers, both amateur and professional, since the early days of the game. There have been great advancements in golf club and golf ball technology. There exists golf clubs with oversize sweet spots that help propel even slightly mishit golf balls in a straight or intended direction. These clubs can now be constructed of titanium and other materials to provide increased distance when striking a golf ball. State-of-the-art golf clubs have shafts composed of carbon fiber and/or graphite materials for increased distance and less shock to the hands and arms of the golfer. However, despite these technologies, a golfer who lacks a proper repeatable golf swing is destined for inconsistency and frustration in the pursuit of golfing success and enjoyment.

The sequence of actions and elements that comprise a golf swing is affected by many factors. For example, a golfer desires to hit a ball 175 yards with a 5-iron golf club. The hitting area of the face of this golf club is 2.5 inches, and the diameter of the golf ball is 1.68 inches. The weight of the golf club, which at rest is typically about 14.5 ounces, builds up a dynamic pulling weight of approximately 100 pounds during a 1.5 second swing while being swung at a peak speed of about 90 miles an hour through its arc of approximately 18 feet. The ball is on the club face for only 0.00035 of a second and must be launched at an angle of 42°. These factors considered with the influences of wind, the quality of the lie of the ball, the fatigue and concentration of the golfer, and other variables and conditions make consistent ball striking and delivery a very daunting task. While the golfer cannot do anything to effect the influence of the wind or other external factors and complexities of the game of golf, he or she can, by developing a consistent and repeatable golf swing, consistently control the flight pattern of the ball, its trajectory, the amount of spin or curve, and the distance that the ball travels. There are numerous elements of a golf swing that have a dynamic influence on the club. These include the alignment of the body at address, the position of the feet, hips, torso and head, the alignment of the arms, the alignment of the hands on the grip, the grip pressure, the relationship of the address position to the ball and the target, the takeaway and subsequent swing plane of the club, the tempo of the swing, the arm extension, the backswing, the subsequent rotation or "coiling" of the body with full shouldered turn, the uncoiling of the body, the weight shift, the downswing, the ball impact, the hand release, the arm extension, the followthrough, the finish and numerous other factors.

Ultimately, a repeatable golf swing can be defined as a fluid chain reaction of good positions. The consistently successful golfer learns to understand, recognize and control the dynamic interface between the golfer, the club, the ball, external forces (lie, wind, weather and other playing conditions) and the target. This can only be achieved by the diligent study and understanding of the game, the swing, the proper frame of mind and effective practice.

Accordingly, there is a need for a training device and method of training to assist golfers in the development of proper technique and muscle memory to achieve a consistently repeatable and effective golf swing. Devices for swing training and teaching proper gripping of a golf club are known in the art, but these devices do not address enough of the technical elements of the swing to be completed effective.

For example, U.S. Pat. No. 3,351,346 to Strahan discloses a golf swing training device. This swing training device has a bent shaft and weighted end displaced from a golf swing center line with a weight that encircles the shaft and can be adjusted vertically thereon. Strahan's swing training device is used to retrain a golfer to perform an inside-out golf swing thus correcting only a single aspect of the swing.

U.S. Pat. No. 4,511,147 to Olsen discloses a training device with a contoured grip to accommodate a golfer's fingers and facilitate exact hand positioning. The device is incorporated with a bent shaft and weighted club head. However this technology can aid only in a few aspects of the swing.

These prior patents are illustrative of attempts that have been made to create a golf swing training device that can aid the golfer in his or her attempt to achieve a repeatable and proper golf swing and a proper grip. Heretofore, however, no comprehensive swing training device has existed that effectively addresses a full range of elements for achieving a proper golf swing and committing the mechanics of such a swing to muscle memory.

SUMMARY OF THE INVENTION

The present invention provides a dynamic swing training device and method for progressively conditioning muscle memory to achieve a consistently repeatable and proper golf swing. The golf swing training device of the present invention in its preferred embodiment is similar to a conventional golf club with an elongated shaft and a handle at one end, but modified to provide a unique dynamic hand, arm and body action during the swing. In the case of a right-handed golfer, the device handle is grasped by the left hand of the trainee, and a slidable grip is provided for grasping by the right hand of the trainee. The slidable grip is slidable longitudinally with respect to the shaft so that the right hand moves progressively down the shaft during the backswing and then progressively back into proximity with the left hand during the downswing. At address the hands are in close proximity as with a conventional golf grip in the address position, then the hands separate during the backswing and return into proximity just prior to the point of impact on the downswing and remain in such proximity during followthrough.

The preferred method using the golf swing training device of the present invention causes the trainee to commit to muscle memory several important aspects and positions of a proper golf swing complemented by the ability to separate the hands during the backswing. For example, the golf swing training device enables the trainee to maintain a substantially straight left arm while at the same time achieving a full shoulder turn and right arm cocking position. Once these two opposing motions have become instinctive through the training method, the trainee can keep the hands together in a conventional golf swing while achieving both proper left arm position and full shoulder turn consistent with the proper golf swing. In the downswing using the preferred golf swing training device, the trainee learns to feel the dynamics of a full club extension and arc that helps facilitate maximum club head velocity and squaring of the club face at the point of impact. The natural wrist roll action that the golf swing training device of the present invention teaches enables the trainee to reproduce a powerful downswing and followthrough. Additionally, it teaches proper stretch for optimum power, proper swing tempo, a desirable inside-out swing, proper body angle at impact, and proper grip alignment during the downswing.

Accordingly, a principal object of the present invention is to provide a golf swing training device having a slidable grip for one hand that permits the hands to separate progressively during the backswing and come back into proximity during the downswing prior to the point of impact in the swing.

Another important object of the invention is to provide a method of training using the training device of the present invention repeatedly to imprint in the mind aspects of an effective golf swing. Yet another important object of the present invention is to provide a golf swing training device having a slidable grip for one hand that permits the hands, from any proximity, to separate progressively during the backswing and come back into proximity during the downswing and come back into proximity during the downswing prior to the point of impact in the swing and that upon return to proximity dynamically align and realign the hand positions of the golfer thereby influencing the golfer into the proper fundamental positions of a golf swing. This effects a 'mental imprinting' of such proper fundamental positions into the 'movement memory' of the golfer. Once imprinted into the golfer's mind in such a manner the golfer can now execute such dynamically memorized positions and alignments reflexively with a conventional golf club thereby executing a proper and fundamental golf swing.

The novel features characteristic of the invention are set forth in the appended claims. The nature of the invention, however, as well as its features and advantages, may be understood more fully upon consideration of illustrative embodiments when read in conjunction with the accompanying drawings, wherein:

DESCRIPTION OF THE PREFERRED EMBODIMENTS

Figure 1:
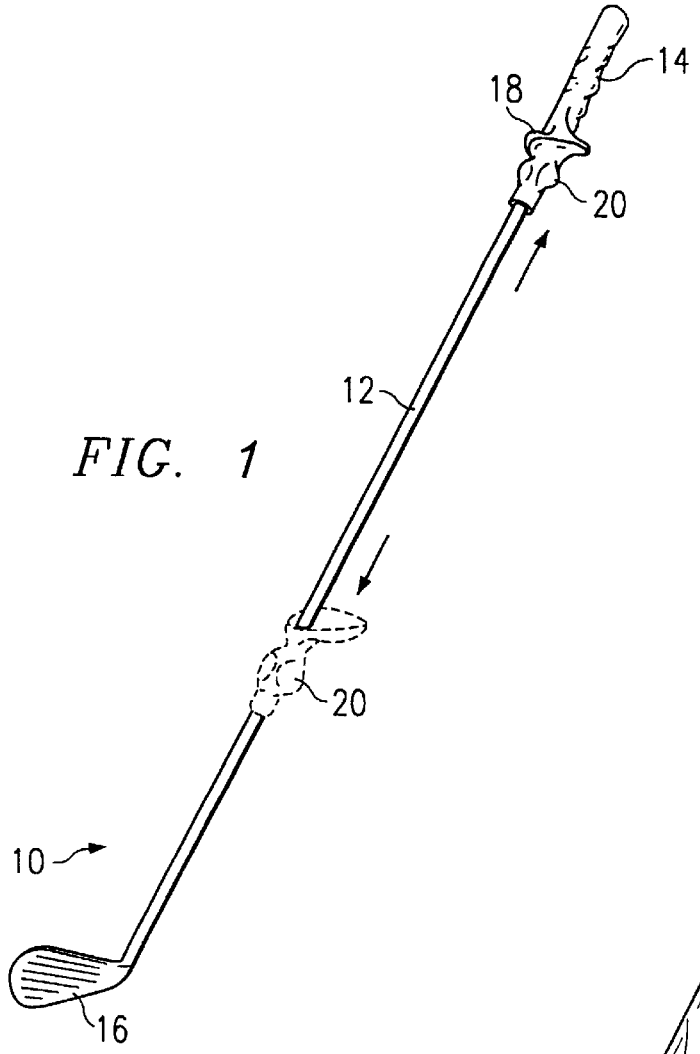
FIG. 1 is a side view of a first embodiment of a golf swing training device in accordance with the present invention, having a slidable right-hand grip and a fixed left-hand grip, the slidable grip being shown in one position in full lines adjacent to the fixed grip and in another position in phantom lines spaced down the shaft from the fixed grip.

A preferred embodiment of the invention is illustrated in FIG. 1 and comprises a modified golf club 10. The golf club has an elongated shaft 12 with a handle 14 at one end and a conventional head 16 at the other end. Alternatively, the conventional head 16 can be replaced by a weight or other nonconventional termination. The golf club 10 shown is a right-handed golf club, but it will be appreciated that the invention applies equally to a left-handed golf club, for which appropriate modifications can be made as will become apparent from the following description. The handle 14 is fixed to the end of the golf club 10 and preferably includes a grip having contoured surface conforming, and correctly positioning and aligning, to the thumb and forefinger of the user's left hand. Additional contoured surfaces can be added to conform to additional fingers of the left hand. The grip 18 and handle 14 are preferably integrally formed as a molded unit using an suitable material or combination of materials, preferably using hard rubber or durable plastic.

Figure 2:
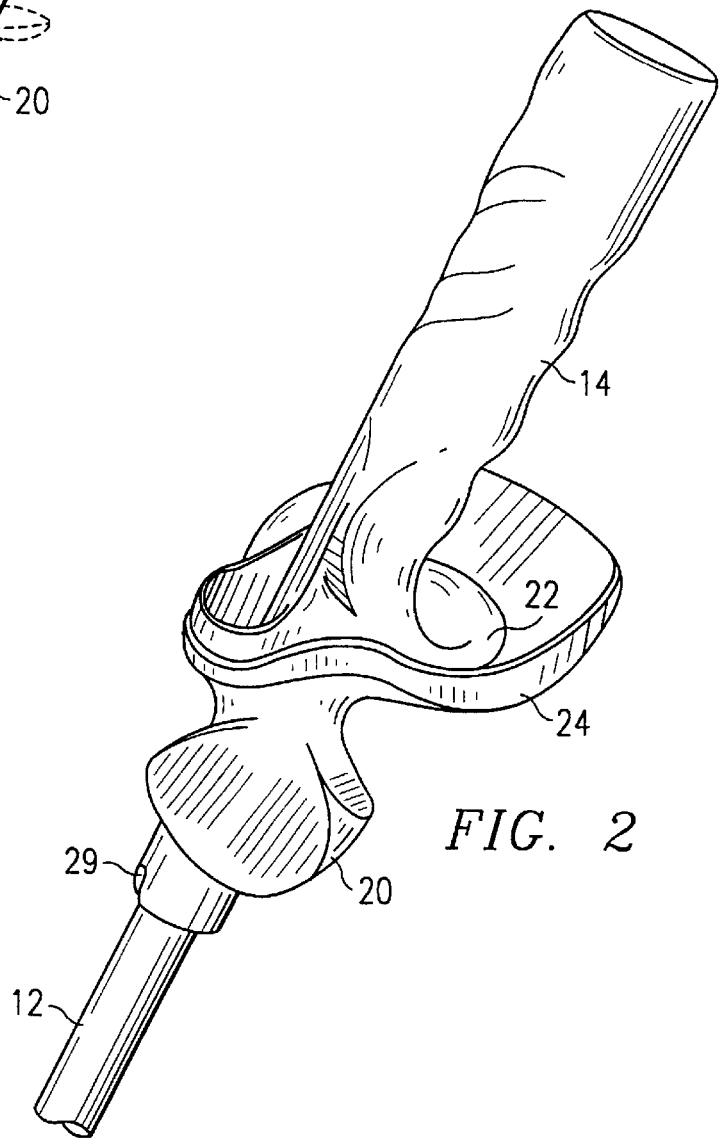
FIG. 2 is an enlarged prospective view of the upper end of the embodiment of FIG. 1 with the right-hand grip moved fully upward into mating and aligning contact with the left-hand grip.
Figure 3:
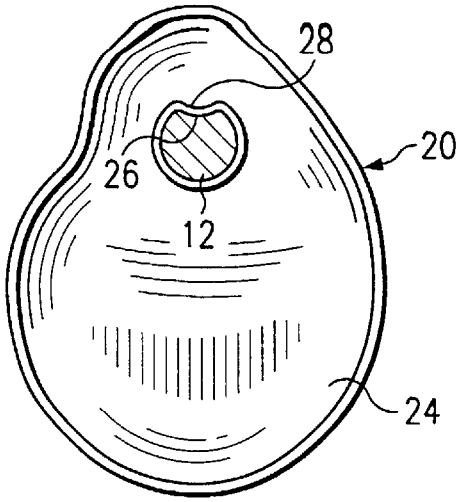
FIG. 3 is a cross section through the shaft of the embodiment of FIG. 1 looking at an upper flared end of the slidable grip.

In accordance with an important feature of the present invention, the device 10 includes a slidable right-hand grip 20, which is shown in two positions with the arrows designating the sliding movement along the shaft 12. The slidable grip 20 is shown in full lines in mating contact with the fixed grip 18 and in phantom lines spaced slightly more than halfway down the shaft. As shown in the enlarged view of FIG. 2, the slidable grip 20 preferably has contoured surfaces that conform to, and correctly position and align, the thumb and fingers of the right hand of the user. The grips 18 and 20 have mating services defined by outwardly extending flairs 22 and 24. FIG. 3 shows the top surface of flair 24, which is part of the slidable grip 20.

Also shown in FIG. 3 is an optional modification that maintains alignment of the grip 20 with the shaft 12 during sliding movement of the grip along the shaft. The shaft 12 may include a groove 26 extending longitudinally along its length at least along the portion that accommodates sliding movement of the grip 20. Correspondingly, the grip 20 has a tongue 28 that extends into the groove 26 so that the grip 20 will not rotate with respect to the shaft 12 during sliding movement.

Figure 4:
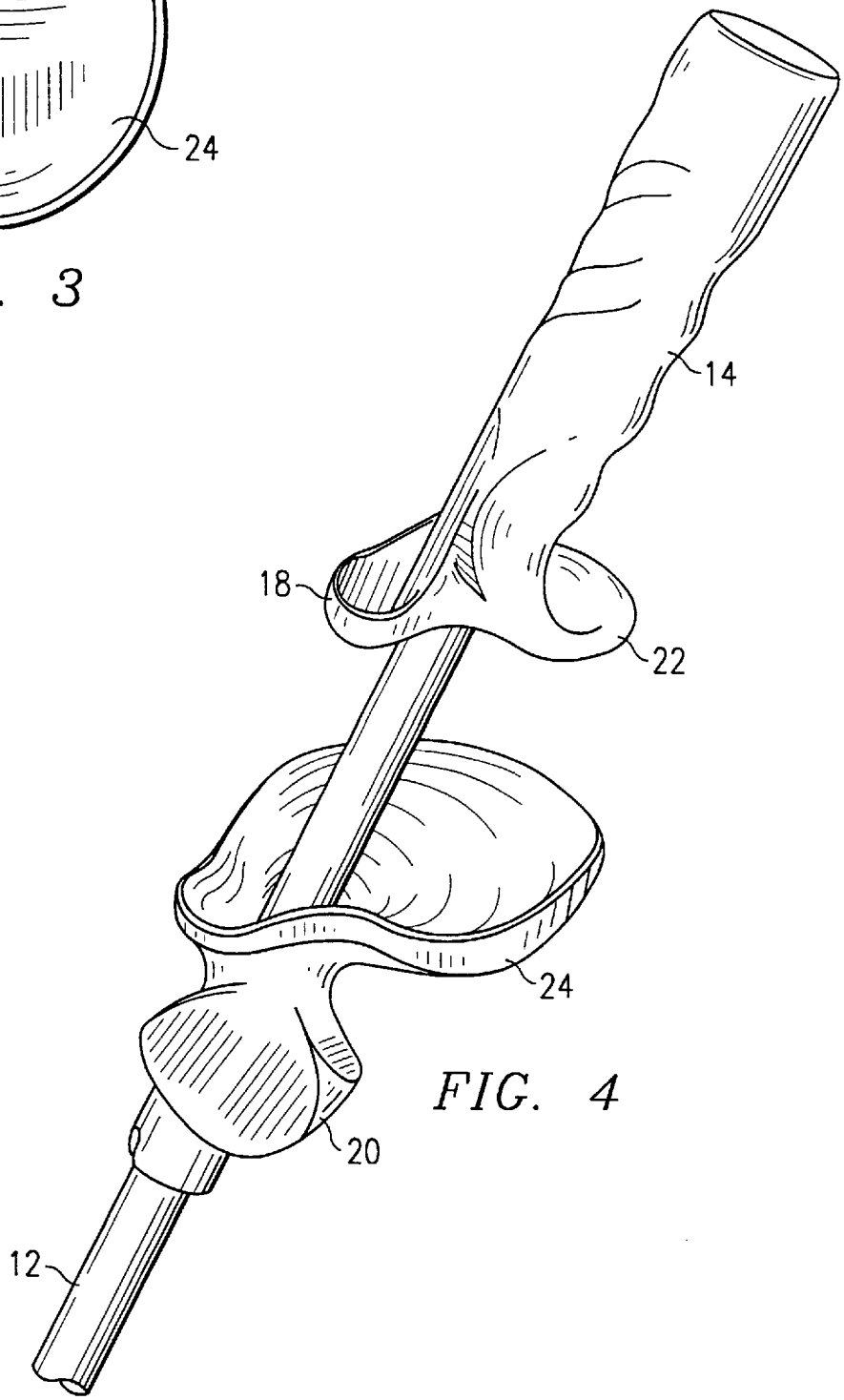
FIG. 4 is another enlarged prospective view similar to FIG. 2 but with the slidable grip slightly separated from the fixed grip viewed from the left side at an angle showing the top surface of the flared end.
Figure 5:
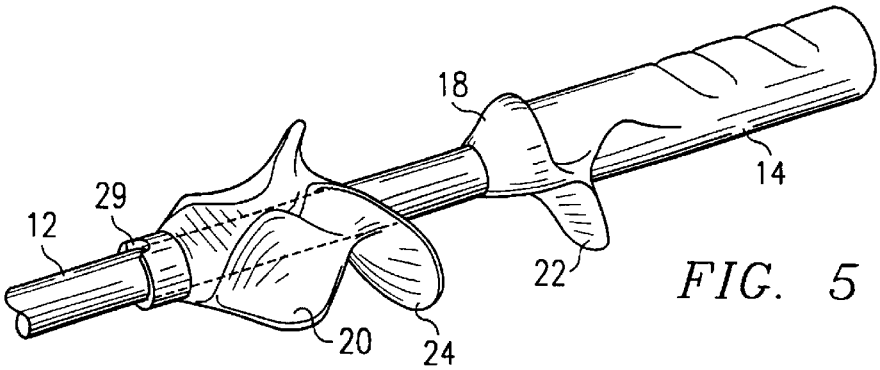
FIG. 5 is another enlarged prospective view similar to FIG. 4 viewed from the left side of the device at an angle showing the bottom surface of the flared end.
Figure 6A:
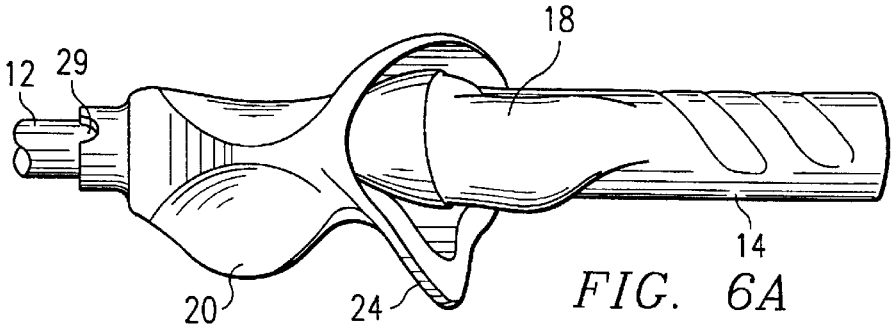
FIG. 6A is a top view of the upper end of the device of FIG. 2 with the slidable grip in mating contact with the fixed grip.
Figure 6B:
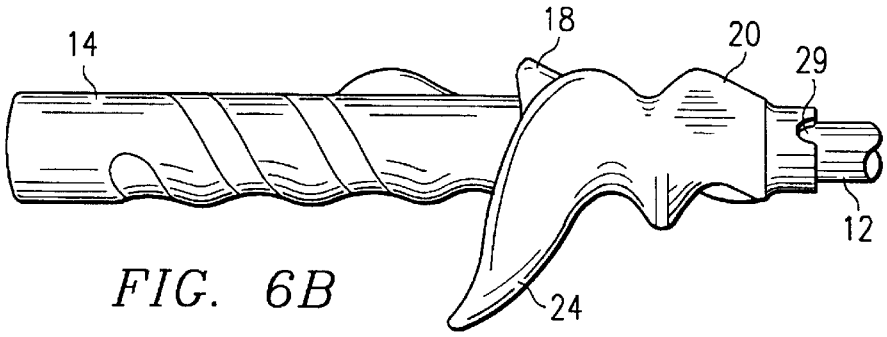
FIG. 6B is a side view of the upper end of the device of FIG. 2 with the slidable grip in mating contact with the fixed grip viewed looking at the right side of the device.
Figure 6C:
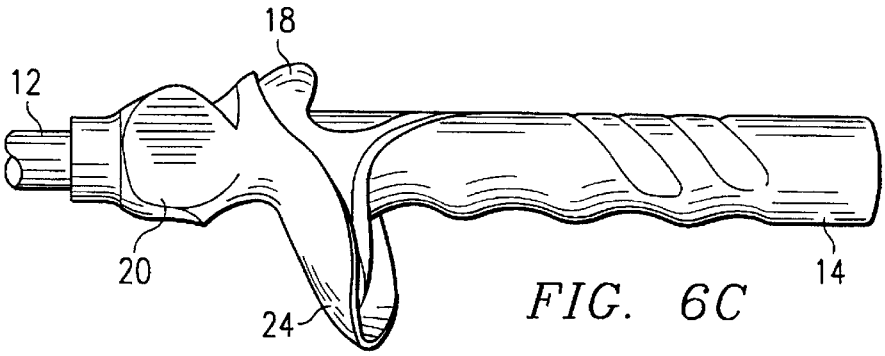
FIG. 6C is a side view of the upper end of the device of FIG. 2 with the slidable grip in mating contact with the fixed grip viewed looking at the left side of the device.

Referring to FIGS. 4 and 5, the slidable grip 20 is shown slightly separated from the fixed grip 18. The flairs 22 and 24 perform multiple functions. First, they provide mating surfaces that keep the slidable grip 20 in proper orientation with respect to the fixed grip when the slidable grip 20 is in abutting contact with the fixed grip 18. Second, the outwardly flared portions 22 and 24 protect the fingers and hands of the user from being pinched when the slidable grip 20 is brought quickly into contact with the fixed grip 18. Third, when the flairs 22 and 24 come back into contact during the downswing, they make a snapping sound at the simulated moment of impact to trigger desired wrist-roll action during followthrough. When the slidable grip 20 is in abutting contact with the fixed grip 18, the hands of the user will be properly positioned in a standard golf grip by employing the contoured surfaces to position the thumbs and fingers of the hands. Additional features of the contoured gripping surfaces of the fixed grip 18 and the slidable grip 20 are revealed in FIGS. 6A, 6B and 6C. In particular, as illustrated best in FIG. 6A, the slidable grip 20 preferably has an alignment notch 29 that squares the slidable grip 20 at the top of the backswing when the slidable grip engages the clubhead 16 with the notch 29 mating with the upper edge of the clubhead.

Figure 7A:
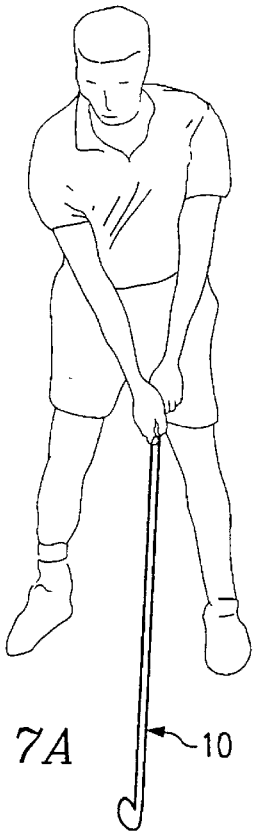
FIG. 7A is a schematic illustration of the use of the device of FIG. 1 with a trainee at the address position.
Figure 7B:
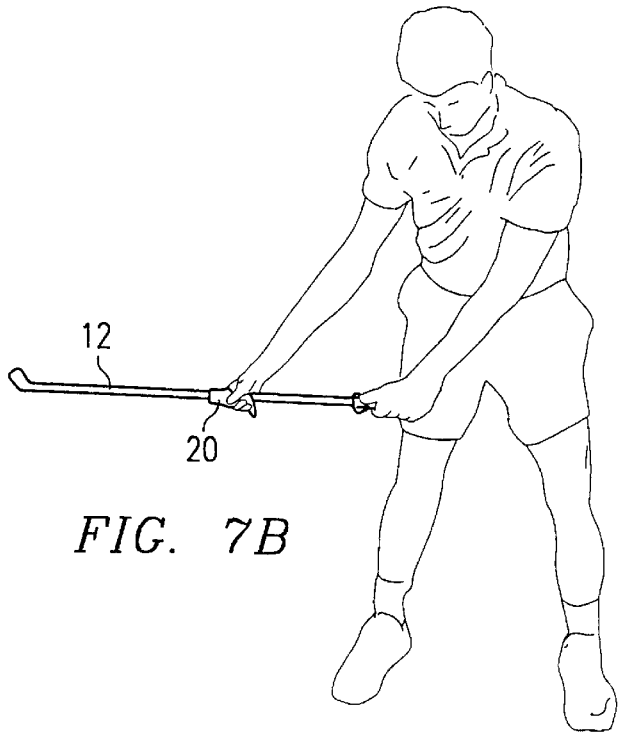
FIG. 7B is a schematic illustration similar to FIG. 7A showing the trainee beginning the backswing with the device.
Figure 7C:
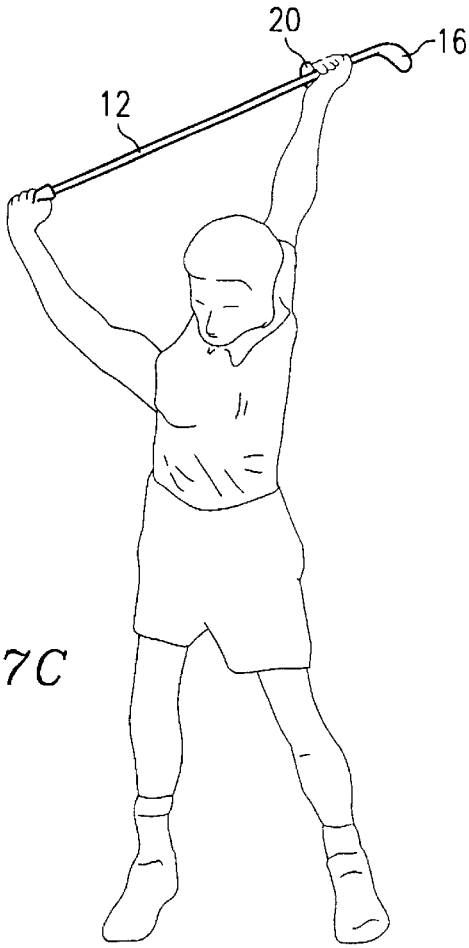
FIG. 7C is a schematic illustration similar to FIG. 7A showing the trainee reaching the top of the backswing.
Figure 7D:
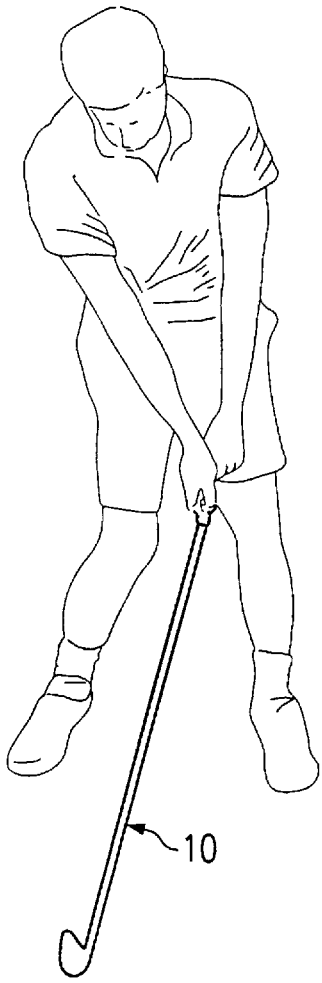
FIG. 7D is a schematic illustration similar to FIG. 7A showing the trainee reaching a point in the downswing where the hands have come back into close proximity just prior to the point of impact.
Figure 7E:
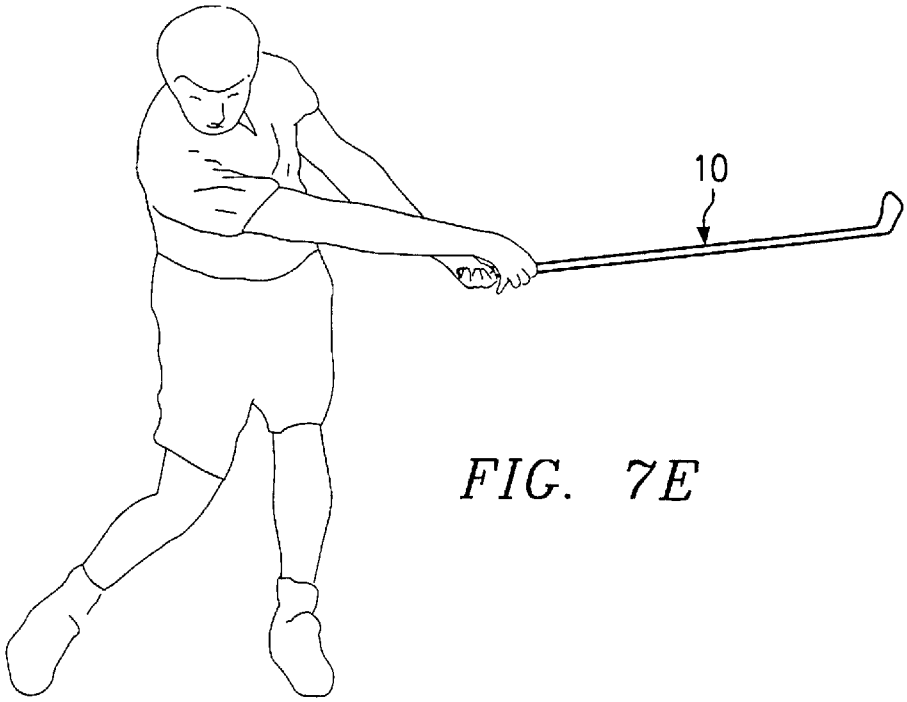
FIG. 7E is a schematic illustration similar to FIG. 7A in which the trainee has swung past the point of impact and is executing the followthrough.

Important additional features of the invention will now be described in connection with FIGS. 7A–E showing the golf swing training device 10 at several positions during a training swing. FIG. 7A shows a trainee at the address position with his left hand grasping the fixed grip and his right hand grasping the slidable grip. In FIG. 7B the trainee has begun the backswing and has started to separate his hands by pushing the slidable grip part way down the shaft 12. FIG. 7C shows the trainee having reached the top of the backswing in a fully coiled position with a substantially straight left arm and the right hand extending to almost the remote end of the shaft. FIG. 7D shows the trainee at a point in the swing just prior to impact in which the hands have been pulled back into close proximity with the slidable grip and fixed grip in mating contact. When the two grips are brought into mating contact, the hands are returned to the proper grip orientation and alignment relative to the handle of the golf club training device 10. FIG. 7E shows the trainee at a point in the golf swing after impact and part way through the followthrough with the hands still in close proximity at the handle of the golf swing training device 10.

A unique feature of the training method of the present invention is revealed by FIGS. 7A–E, which show the trainee separating his hands progressively during the backswing to a point of maximum separation at the top of the backswing and then progressively bringing the hands back into close proximity just prior to impact during the downswing. As seen best in FIGS. 7B and 7C, this training method enables the trainee to maintain his left arm in a substantially straight position during the backswing. It is well known that this is an important feature of an effective golf swing. By keeping a substantially straight left arm, the golfer can move the golf club through an arc that brings it back to its starting position at the point of impact to facilitate proper contact between the club face and the ball.

Another feature of the unique training method seen best in FIGS. 7B and 7C is the ability to separate the hands during the backswing. This enables the trainee to stretch and make a full shoulder turn without bending the left arm. This separation and slide of the hands from proximity during the backswing and subsequent return to proximity during the downswing teaches the proper rhythm and tempo of a golf swing in addition to teaching the proper inside out swing path of the golf club during the downswing. By repeatedly practicing the hand separation and return technique of the inventive method, the trainee can learn or imprint in muscle memory these important aspects of an effective golf swing. When the trainee then uses a conventional golf club and keeps his or her hands together on the handle at all times during the swing, the natural tension between the straight left arm position and the full shoulder turn position will compromise to produce a mechanically effective and technically correct golf swing motion.

Another feature of the inventive training method is that the use of the slidable grip 20 promotes proper grip pressure with the right hand, both by virtue of the dynamic sliding motion and due to the contoured surfaces for the thumb, forefinger and second finger of the right hand. In other words, the third and fourth fingers of the right hand are slightly open resting against the back of the flair 24 so that they remain relaxed during the swing. The thumb, forefinger and second finger of the right hand apply pressure to the slidable grip 20, but the pressure is minimized due to the sliding action during the swing, during which the left hand properly applies most of the gripping pressure.

Figure 8:
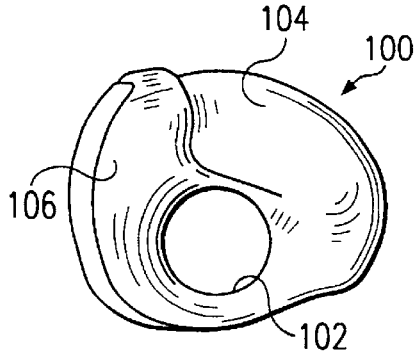
FIG. 8 is an end view of an alternative slidable grip of the present invention.
Figure 9:
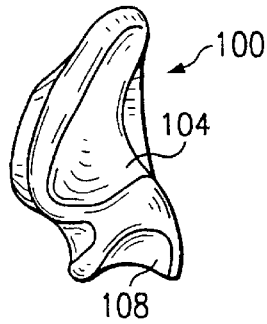
FIG. 9 is a side view of the slidable grip of FIG. 8.
Figure 10:
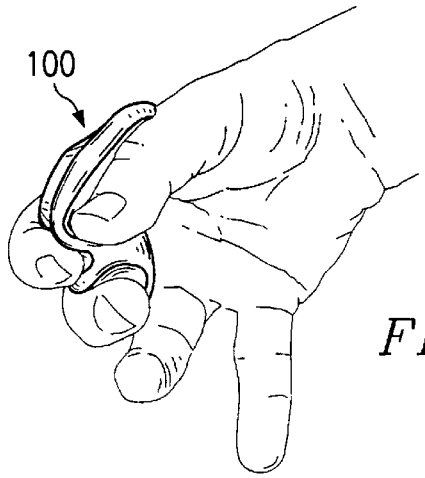
FIG. 10 is a schematic illustration showing the right hand of a trainee grasping the alternative slidable grip in its intended manner.
Figure 11:
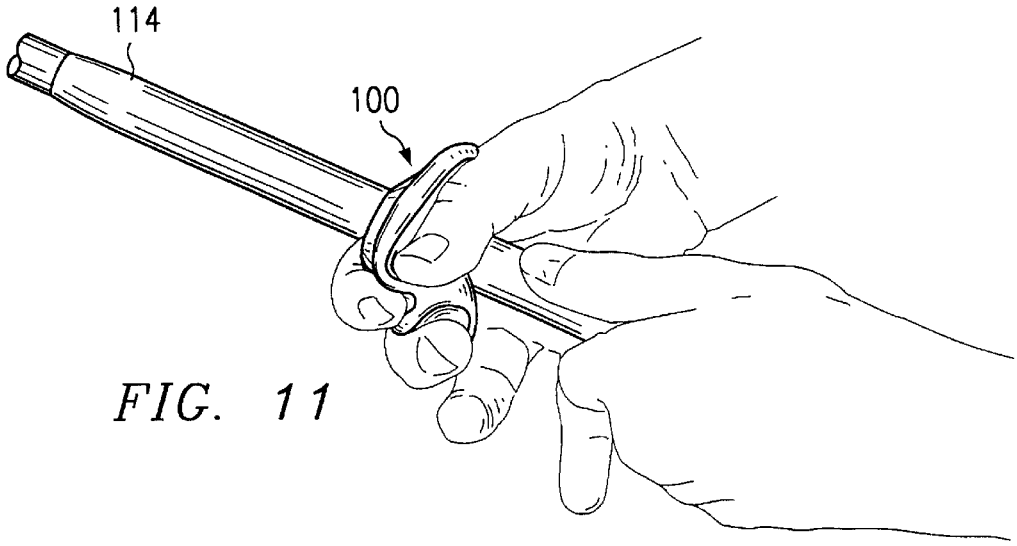
FIG. 11 is a schematic illustration showing the use of the alternative slidable grip on a conventional golf club handle.

An alternative embodiment of the invention will now be described with reference to FIGS. 8–11. FIGS. 8 and 9 show a slidable grip designated generally by reference 100. The slidable grip 100 is designed for gripping by the right hand of a trainee as shown in FIGS. 10 and 11. As seen in FIG. 8, the slidable grip 100 has a hole 102, which is sized to permit a standard golf club handle, designated by 114 in FIG. 11, to be inserted through the opening 102. The slidable grip 100 preferably includes contoured surfaces for the thumb and first two fingers of the right hand. A hard durable plastic, rubber or combinations thereof, are suitable materials for the grip 100. The contoured surfaces include a thumb socket 104, an index finger socket 106, and a second finger socket 108. These sockets are arranged to teach proper positioning of the thumb and first two fingers of the right hand, and to teach the trainee to provide moderate grip pressure with the thumb and first two fingers of the right hand and essentially no pressure with the third and fourth fingers of the right hand. It is well known that the left hand of a right-handed golfer needs to be the dominant hand in preforming a golf swing. Thus, the present invention facilitates training a golfer in the mechanics of proper grip pressure and facilitates the method of use as taught herein. The alternative embodiment 100 of FIGS. 8–11 can be used to execute a training swing similar to that shown in FIGS. 7A–E. As a further alternative that is effective in teaching swing mechanics, grip 100 can be modified in the form of a cylinder without the contoured surfaces for the fingers. This alternative can provide a slidable grip without having to customize its outer surfaces to fit various hand sizes, yet can facilitate to a degree the method of use described herein.

Now referring to FIGS. 12 and 13, another alternative embodiment of the present invention, which is designated generally by reference numeral 200, will be described. The golf swing training device 200 is similar to the device 10 of FIG. 1 with the addition of a stop ring 202. The stop ring 202 is shown in full lines abutting a slidable grip 220 and in phantom lines at two different positions along the shaft 12. The stop ring 202 preferably includes a contoured upper surface that mates in one rotational orientation with a lower rotating surface of the slidable grip 220. This causes the trainee to properly position his right hand as shown in FIG. 13 so that club head 16 is properly oriented at the top of the backswing. Slidable grip 220 in other respects is like the slidable grip 20 previously described.

Figure 12:
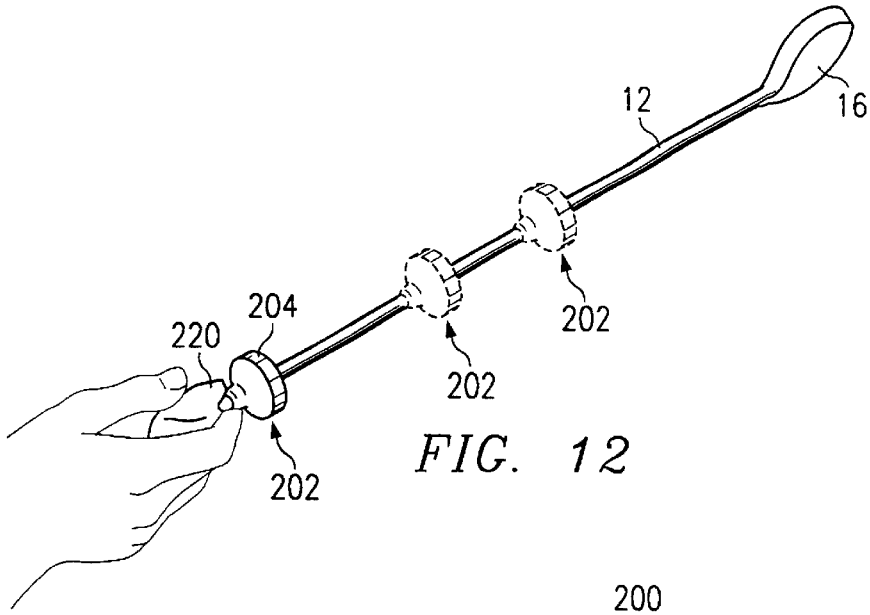
FIG. 12 is a schematic prospective view of another alternative embodiment of the swing training device with a positionable stop ring.
Figure 13:
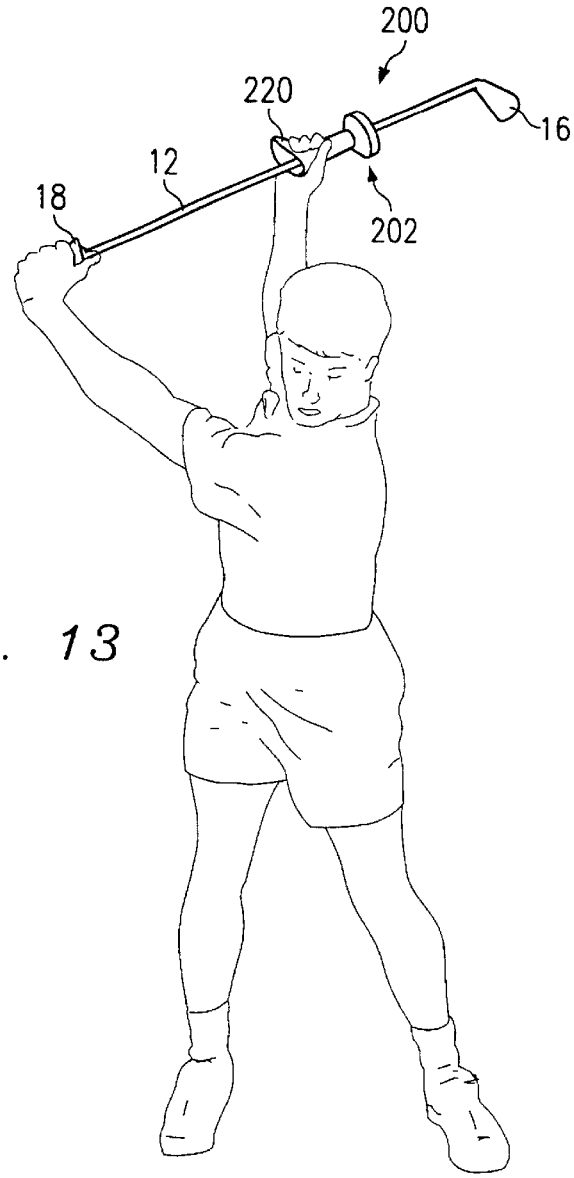
FIG. 13 is a schematic illustration of a trainee using the alternative embodiment of FIG. 12.

The stop ring 202 may be positioned at any location along the shaft 12 between the upper end as shown in full lines in FIG. 12 and the remote end near the head 16. The stop ring 202 has suitable means for securing it in position along the shaft 12 such as by means of a clamp (not shown) or other frictional engagement means. Such a clamp can be provided within an outwardly flared collar 204. Alternatively, a conventional set-screw (not shown) or other such means can be used to secure the stop ring 202 at a selected position along the shaft 12.

FIG. 13 shows the stop ring 202 in use during a training swing. By securing the stop ring 202 in the position shown, the trainee has the sliding motion of his right hand restricted. FIG. 13 shows the trainee executing a golf swing arriving at the top of the backswing with the slidable grip 220 abutting the stop ring 202. During the course of training, the stop ring 202 is moved progressively up the shaft at spaced intervals until it finally is positioned all the way up the shaft as shown in full lines in FIG. 12. Thus, for example, each day the stop ring 202 can be moved several inches up the shaft 12 so that the trainee progressively brings his or her hands closer together until they are adjacent to each other as in a conventional golf swing. Additionally, when the slidable grip 220 is in abutment with the stop ring 202 the golfer can pause in such position as shown in FIG. 13 and by a pushing motion of the slidable grip 220 against stop ring 202 can effect a stretching motion on the body of the golfer thereby causing the golfer to stretch the appropriate muscles of the body that are involved in the maximum 'coiling' of the body. Upon 'release' of this coiling there is effected the maximum clubhead speed during the downswing and follow-through of the golf swing. Thus, the results of this stretching and the muscle memory of these positions are retained in the 'muscle memory' of the golfer and can then be executed by the golfer with a conventional golf club.

Figure 14:
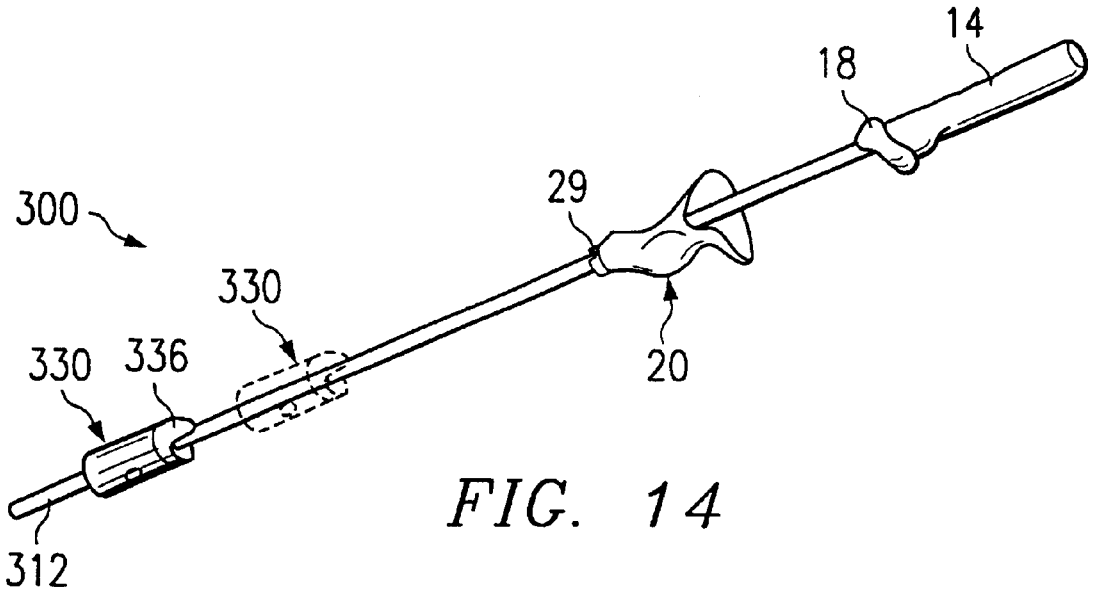
FIG. 14 is a schematic side view of another alternative embodiment of the golf swing training device with a positionable weight.

Now referring to FIGS. 14 and 15, another alternative embodiment generally designated by reference numeral 300 will be described. For occasions when the trainee would like to practice the training method in a confined space (i.e., indoors) the alternative swing training device 300 has a shortened shaft 312, which is preferably a maximum of 24 inches from end to end. In order to give the training device 300 the feel of a conventional golf club, a weight 330 is provided on the shaft 312. The weight 330 is preferably slidable along the shaft 312 and includes means for locking it at selected positions along the shaft, a first position being shown in full lines and a second position being shown in phantom lines. By locating the weight at different positions along the shaft, the angular momentum of different clubs from driver to wedge can be simulated.

Figure 15:
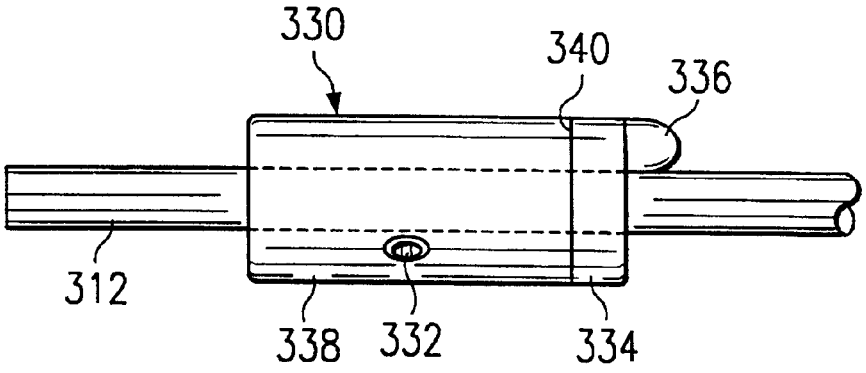
FIG. 15 is an enlarged view of the positionable weight of FIG. 14.

Referring specifically to FIG. 15, the weight 330 has a set-screw 332 or similar locking means that can be used to secure the weight 330 at a selected position along the shaft 312 by tightening the set-screw 332 against the shaft 312. An additional feature of the weight 330 that can be included is a contoured upper portion 334 that includes a projection 336. The upper portion can be rubber or molded plastic and can be glued or otherwise joined to a main body portion 338 along an interface 340. The main body 338 of the weight 330 is preferably metal. Referring again to FIG. 14, the projection 336 is shaped to mate with the match 29 at the lower end of a slidable grip 20. This serves a similar purpose as the mating of the slidable grip 220 and the stop ring 202 as described above with reference to FIG. 13. Alternatively, weight 330 can be fixed at the remote end of a stop ring like that shown in FIGS. 12 and 13 can be employed.

From the foregoing, it will be appreciated that the present invention provides a unique swing training device and method for its use in training a golfer to execute an effective golf swing. The present invention contemplates that similar concepts can have application for training in other sports. For example, a slidable grip could be used effectively with a baseball swing training device generally similar to a conventional baseball bat. Although the invention has been described with reference to several preferred and alternative embodiments, it will be understood by those skilled in the art having reference to the current specification and drawings, that various modifications may be made and further alternatives are possible without departing from the spirit and scope of the invention as set forth in the appended claims.

What is claimed is:

1. A method for training an individual to develop effective swing mechanics for a golf swing, the method being practiced with a training device having an elongated shaft with first and second ends, a handle at the first end for grasping by a first hand of the user, and a slidable grip slidable longitudinally along the shaft for grasping by a second hand of the user, the method comprising the steps:

(a) grasping the handle with the first hand;

(b) grasping the slidable grip with the second hand;

(c) bringing the hands into close proximity;

(d) assuming an address position;

(e) taking the training device through the motion of a backswing while progressively sliding the slidable grip down the shaft;

(f) taking the training device through the motion of a downswing while progressively sliding the slidable grip up the shaft to bring the hands back into close proximity at an impact position in the swing; and (g) taking the training device through the motion of a followthrough.

2. The method of claim 1 wherein the training device is provided with a stop bar that is selectably securable along the shaft for stopping the longitudinal movement of the slidable grip at a position that varies with the position of the stop bar; and wherein the steps (a) through (g) are repeated during a course of training in which the stop bar is progressively moved closer to the handle, ultimately preventing sliding of the slidable grip so that the hands remain in close proximity during the entire swing.

* * * * *